US010336948B2

(12) United States Patent
Feugnet et al.

(10) Patent No.: US 10,336,948 B2
(45) Date of Patent: Jul. 2, 2019

(54) CATALYTIC CRACKING PROCESS ALLOWING IMPROVED UPCYCLING OF THE CALORIES FROM THE COMBUSTION FUMES

(71) Applicant: IFP Energies nouvelles, Rueil-Malmaison (FR)

(72) Inventors: Frederic Feugnet, Lyons (FR); Jean-Michel Besnault, Vesinet (FR); Patrick Briot, Pommier de Beaurepaire (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 257 days.

(21) Appl. No.: 14/594,833

(22) Filed: Jan. 12, 2015

(65) Prior Publication Data

US 2015/0197695 A1 Jul. 16, 2015

(30) Foreign Application Priority Data

Jan. 10, 2014 (FR) ..... 14 50194

(51) Int. Cl.
*C10G 11/05* (2006.01)
*C10G 11/18* (2006.01)

(52) U.S. Cl.
CPC ..... *C10G 11/05* (2013.01); *C10G 11/185* (2013.01)

(58) Field of Classification Search
CPC ..... C10G 11/18; C10G 11/185; C10G 11/05
See application file for complete search history.

(56) References Cited

U.S. PATENT DOCUMENTS 4,272,402 A * 6/1981 Mayes ..... B01J 8/18 208/113
4,814,068 A 3/1989 Herbst et al.
4,989,669 A * 2/1991 Barnes ..... B01J 8/1836 165/104.16
5,198,194 A * 3/1993 Owen ..... B01J 38/38 208/113
5,365,006 A * 11/1994 Serrand ..... B01J 8/067 422/139
5,571,482 A * 11/1996 Long ..... B01J 38/32 208/164
5,770,161 A * 6/1998 Ochi ..... B01D 53/346 422/111
2008/0128325 A1* 6/2008 Khan ..... B01J 23/10 208/67
2009/0035191 A1 2/2009 Couch et al.
2015/0090636 A1* 4/2015 Lorsbach ..... C10G 11/182 208/113

* cited by examiner

*Primary Examiner* — Prem C Singh
*Assistant Examiner* — Brandi M Doyle
(74) *Attorney, Agent, or Firm* — Millen, White, Zelano & Branigan, PC

(57) ABSTRACT

The present invention describes a process for the production of gasoline using a catalytic cracking unit, processing conventional heavy cuts in a wide Conradson carbon range from 0.1 to 0.8, said process comprising a preheating of the combustion air downstream of the air compressor by heat exchange with the combustion fumes originating from the regeneration section, said fumes being collected between the waste heat boiler and the economizer.

20 Claims, 2 Drawing Sheets

CATALYTIC CRACKING PROCESS ALLOWING IMPROVED UPCYCLING OF THE CALORIES FROM THE COMBUSTION FUMES

FIELD OF THE INVENTION

The present invention belongs to the field of the catalytic cracking of petroleum cuts.

The main objective of the catalytic cracking unit of a refinery is the production of bases for gasoline, i.e. cuts having a distillation range comprised between 35° C. and 250° C.

In a catalytic cracking unit (denoted FCC), the heat balance is ensured by combustion of the coke deposited on the catalyst during the reaction stage. This combustion takes place in the regeneration zone by injection of air via a compressor called the "main air blower", abbreviated to MAB.

Typically, the catalyst enters the regeneration zone with a coke content (defined as the mass of coke over the mass of catalyst) comprised between 0.5% and 1%, and exits said zone with a coke content of less than 0.01%. During this stage, combustion fumes are generated and leave the regeneration zone at temperatures comprised between 640° C. and 800° C. Depending on the configurations of the unit these fumes will then undergo a certain number of post-treatments in order to:

- recover a proportion of their heat for the purpose of producing steam,
- remove from them solid particles referred to as fines and originating from the catalyst,
- scrub them to remove the nitrogen- and sulphur-containing compounds (referred to by the generic terms NOx and SOx).

Following these stages, the combustion fumes can be emitted into the atmosphere via a chimney of the refinery, meeting current environmental standards.

The steam produced by recovery of the heat from the fumes is divided into three different heat levels and consequently three different pressure levels.

A distinction is therefore drawn between steam production referred to as high-pressure (HP), medium-pressure (MP) and low-pressure (LP).

- High-pressure steam is generally in a temperature range comprised between 380 and 450° C. for a pressure range between 45 and 100 bar (1 bar=$10^5$ Pa).
- Medium-pressure steam will be in a temperature range of 220 to 350° C. for a pressure range between 15 and 40 bar.
- As for low-pressure steam, it is situated in a lower temperature range comprised between 170 and 250° C. for a pressure level comprised between 2.5 and 10 bar.
- These ranges can vary substantially depending on the refinery in question and its utilities network.

High-pressure steam of the highest heat level is the most sought-after to the extent that it can be a high-temperature heat source for a wider range of process flows than medium-pressure steam which, for its part, is more useful than low-pressure steam, the outlets of which remain limited in the refinery due to its low heat level, thus limiting its use as a heat source.

The feedstock of an FCC unit is generally constituted by a hydrocarbon or a mixture of hydrocarbons essentially containing (i.e. at least 80%) of molecules, the boiling point of which is greater than 340° C. This main feedstock also contains limited quantities of metals (Ni+V), in a concentration generally less than 50 ppm, preferentially less than 20 ppm, and a hydrogen content generally greater than 11% by weight, typically comprised between 11.5% and 14.5%, and preferentially comprised between 11.8% and 14% by weight.

The Conradson carbon residue of the feedstock (abbreviated to CCR and defined by the standard ASTM D 482) provides an assessment of coke production during the catalytic cracking process. Depending on the Conradson carbon residue of the feedstock, the yield of coke requires specific dimensioning of the unit in order to satisfy the heat balance.

Thus, when the feedstock has a CCR leading to a coke content greater than that required in order to ensure the heat balance, the excess heat must be removed. This can be done for example, and non-exhaustively, by the installation of a "cat cooler", an exchanger well known to a person skilled in the art, which externally cools a fraction of the catalyst contained in the regenerator by exchange with water, thus leading to the production of high-pressure steam.

Conversely, in certain cases, in particular with naphtha-type light feedstocks, the feedstock treated in the FCC has insufficient coke, and the heat balance must be achieved by the addition of a supplementary heat source. This can be implemented in different ways known to a person skilled in the art, such as for example increasing the preheating of the feedstock, which leads to an increase in the size of the preheating furnace and in the consumption of the associated utility, or by the addition, at the level of the regenerator, of a cut originating from the FCC with a high coke potential, referred to as a coking cut which is generally the "slurry" cut, i.e. a predominantly aromatic 360° C.+ cut, or any hydrocarbon cut such as Fuel Oil No. 2 or domestic fuel.

This recycling of a "slurry" cut or a Fuel Oil No. 2 cut to the regenerator is problematic since, because of the temperatures prevailing in the regenerator, of the order of 650° C. to 750° C., a portion of that recycle vaporizes, forming cracked gases which will be found in the diluted phase of the regenerator, thus risking the creation of hot spots which can damage the correct operation of the unit.

This phenomenon, called "afterburning", can be defined as a resurgence of combustion at an unwanted point in the unit, in particular at the inlet to the cyclone.

Moreover, this recycle stream runs the risk of burning in the catalyst bed, forming a local high temperature flame front which can subject the catalyst to local high temperatures (hot spots).

These local high temperatures, combined with the presence of steam, weaken the active part of the catalyst (zeolite) and thus deactivate its cracking function.

The heavy cuts treated in the FCC can in particular originate from atmospheric distillation, vacuum distillation, the hydroconversion unit, coking unit, hydrotreatment or deasphalting unit, but also have a biomass-type origin such as for example vegetable oils or cellulose.

The benefit of the present invention consists of preheating the combustion air at the outlet of the main air compressor (MAB) with the combustion fumes or any other sources of calories of a heat level compatible with an exchange with the air.

This particular implementation thus makes it possible to transfer part of the production of low-pressure (LP) steam to high-pressure (HP) steam and/or to limit the utilities of the process such as fuel oil or fuel gas or coking cut, by improving the energy efficiency of the unit in this way.

EXAMINATION OF THE PRIOR ART

The heat exchange system using the combustion fumes collected at the outlet of the regenerator of a catalytic cracking unit conventionally comprises a steam generation boiler known as a waste heat boiler ("waste heat boiler") and an exchanger referred to as an economizer which makes it possible to generate low-pressure steam and superheated water.

- U.S. Pat. No. 3,769,203 describes the preheating of the feedstock to the required temperature before its introduction into the riser.
- U.S. Pat. No. 7,491,315 describes indirect preheating of the feedstock by the fumes originating from the regenerator.
- U.S. Pat. Nos. 3,838,038 and 6,558,531 describe an increase in the temperature of the catalyst in the transfer line leading from the stripper to the regenerator.

We have not found any document describing an exchange of heat between the regeneration fumes at a level situated between the electrostatic separator and the economizer, and the combustion air leaving the air compressor.

The combustion fumes leave the regenerator (REG) and enter the waste heat boiler (WHB) which makes it possible to generate high-pressure superheated steam (HPSH) from feed water under pressure (HPBFW) and medium-pressure superheated steam (MPSH) from medium-pressure steam (MPS).

The fumes then enter the electrostatic precipitator (ESP) and then an exchanger known as an "economizer" which produces low-pressure superheated (LPSH) steam from low-pressure water (LPBFW) and high pressure superheated water (HPBFW) from high-pressure water.

Figure 1:
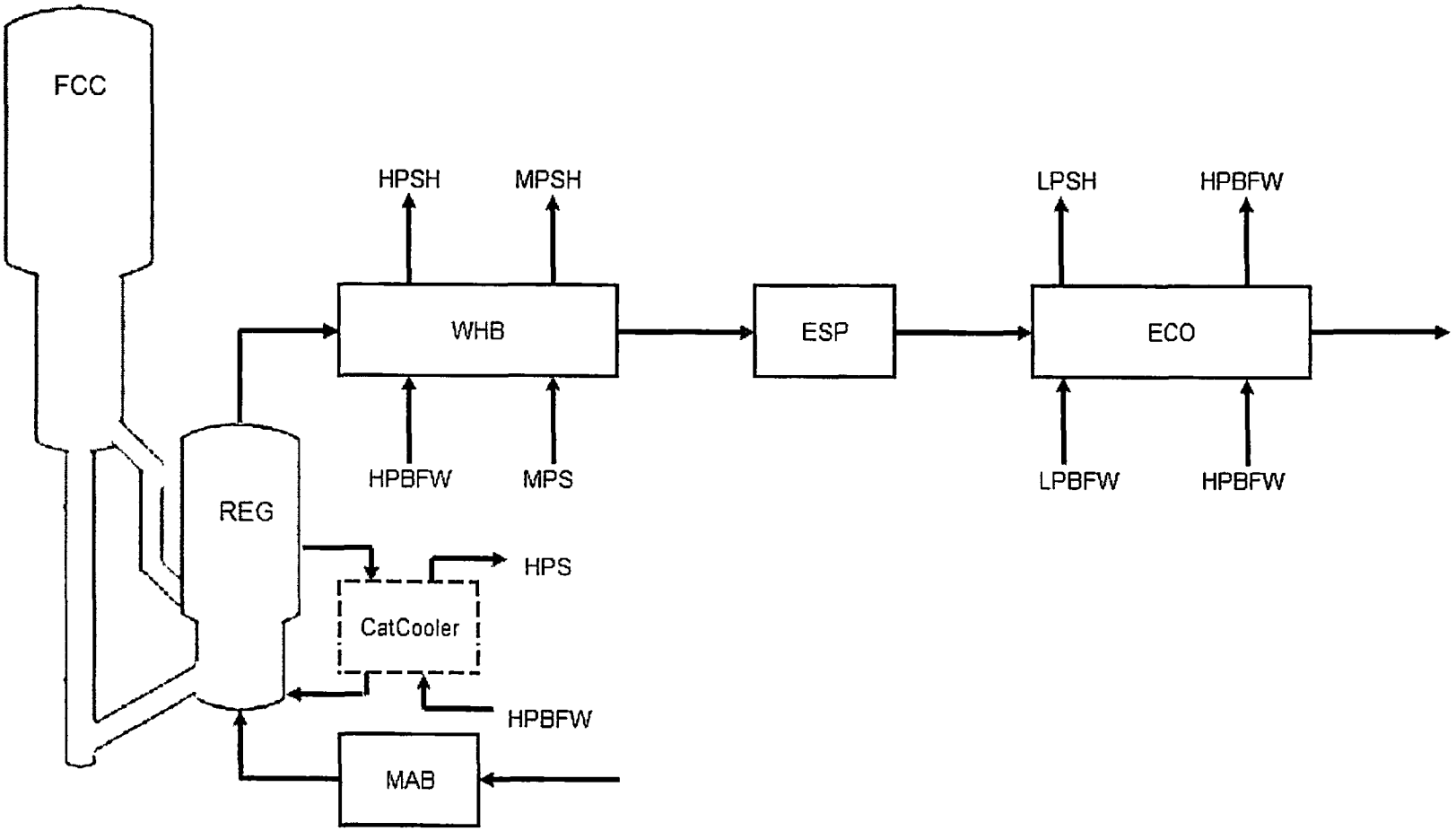
FIG. 1 shows the heat-exchange train of the combustion fumes according to the prior art, as well as the combustion air circuit up to its entry into the regenerator.

FIG. 1 also shows the fluidized solid exchanger known as a "cat cooler" which makes it possible to generate high-pressure steam (HPS) from high-pressure water (HPBFW).

Figure 2:
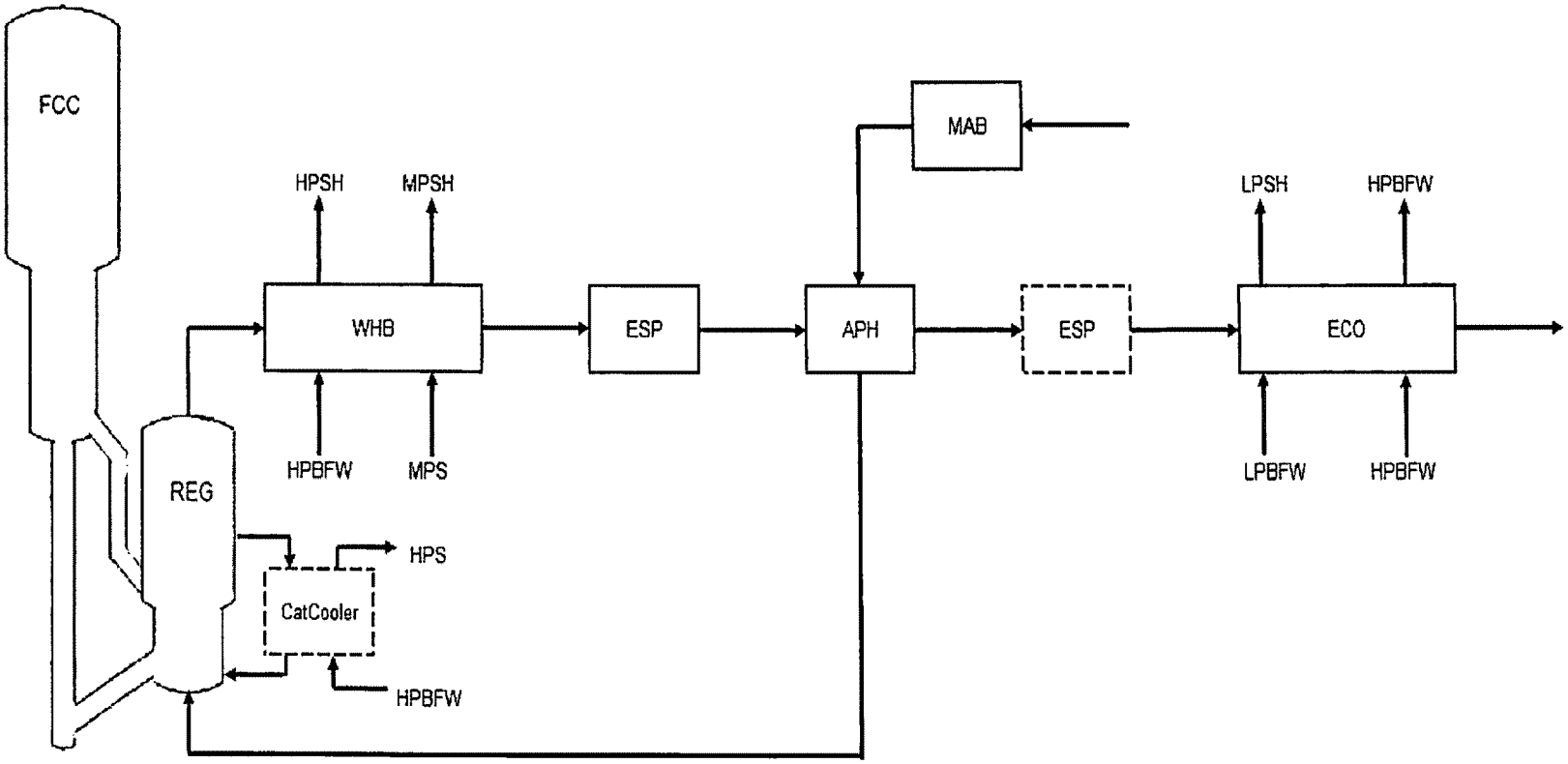

FIG. 2 shows the heat-exchange train of the combustion fumes according to the invention.

The novel exchanger is denoted APH. It makes it possible to preheat the combustion air downstream of the compressor (MAB) using the fumes collected between the electrostatic precipitator (ESP) and the economizer (ECO). The remainder of the diagram is identical to that of FIG. 1.

BRIEF DESCRIPTION OF THE INVENTION

The present invention essentially relates to a novel heat exchange on the line for recovery of the heat from the combustion fumes. This exchange takes place between the fumes from the regenerator collected downstream of the waste heat boiler (known as a "waste heat boiler" to a person skilled in the art and denoted WHB), and upstream or downstream of the electrostatic precipitator (ESP) on the one hand, and the combustion air downstream of the compressor on the other hand. The novel heat exchange is preferably carried out on the combustion fumes collected between the electrostatic precipitator (ESP) and the exchanger called an economizer (ECO).

This heat exchange is carried out by means of an exchanger which can be of any type known to a person skilled in the art, such as a plate exchanger, or a structured-tube exchanger or also a rotary-type exchanger.

In the systems of the prior art, the resulting temperature of the combustion air downstream of the compressor lies between the ambient temperature and the compression factor necessary to bring the air to the pressure of the regenerator. This temperature is generally situated between 110° C. and 300° C., preferentially 150-250° C. With the novel heat exchange according to the invention, the combustion air is heated to between 200 and 350° C. and preferentially between 250° C. and 300° C.

By this novel heat exchange, the calories carried by the regenerator fumes are transferred to the inside of the regenerator via the combustion air entering.

These calories are thus at a high heat level, the temperature of the regenerator typically being situated around 700° C./800° C.

In the general case of relatively coking feedstocks therefore requiring the installation of an external exchanger operating on a branch circuit of the catalyst contained in the regenerator, an exchanger called a "cat cooler", in order to maintain the heat balance of the FCC, this excess heat is removed by the production of high-pressure steam via said "cat cooler".

The "cat cooler" is a fluidized bed exchanger the operation of which is based on the calories directly contained on the hot catalyst (600° C. to 700° C.) in the process of regeneration and which makes it possible to produce high-pressure steam (HPS).

Thus instead of producing low-pressure steam as in the economizer, the novel arrangement makes it possible to produce additional high-pressure steam at a higher heat level than the low-pressure steam produced according to the prior art, and therefore allows heat exchanges using this high-pressure steam as a heat source which is much greater than with low-pressure steam.

In the case of low-coking feedstocks for which the heat balance is ensured by an external heat source (e.g. fuel oil for preheating the feedstock), the additional supply of heat resulting from the novel heat exchange according to the invention makes it possible to reduce the consumption of said external heat source.

Thus instead of producing low-pressure steam and consuming fuel oil, no more low-pressure steam is produced, whilst economizing on the fuel oil. In this case also, the arrangement according to the present invention makes it possible to raise the heat level of the utility generated with respect to the system of integration according to the prior art.

In summary, the arrangement according to the present invention makes it possible to better upcycle the heat from the combustion fumes by producing a utility of a higher heat level which can therefore be more easily upcycled than according to the system of the prior art.

To be more precise, the present invention can be seen as a process for the catalytic cracking of heavy cuts of VGO type or atmospheric residue, with Conradson carbon ranging from 0.1 (or even a value less than 0.1), to values greater than 0.4 and preferentially greater than 0.5, a process using a fluidized bed catalytic cracking unit comprising a reaction section with an upward flow or with a downward flow, and a catalyst regeneration section which consists of combustion of the coke deposited on the catalyst in the reaction section by means of combustion air, said process being characterized in that said combustion air is preheated to a temperature comprised between 200 and 350° C. and preferentially between 250° C. and 300° C. by means of heat exchange using the regeneration fumes collected downstream of the waste heat boiler and upstream of the economizer, combustion fumes available at this location at a temperature comprised between 300° C. and 650° C., the excess calories supplied by the combustion air being converted according to two specific cases:

a) when the catalytic cracking unit comprises a regenerated catalyst exchanger known as a "cat cooler" making it possible to generate HP steam, the excess heat is converted to high-pressure steam (HP steam, i.e. comprised between 45 bar and 100 bar, and preferentially comprised between 50 and 70 bar) at the level of the external exchanger on hot catalyst collected at the regenerator called a "cat cooler", b) when the catalytic cracking unit does not comprise a regenerated catalyst exchanger referred to as a "cat cooler", the excess heat makes it possible to reduce the consumption of fuel by the furnace for preheating said combustion air.

The catalytic cracking unit can operate equally well with an upward flow (referred to as a "riser") and with a downward flow (referred to as a "dropper").

When the catalytic cracking unit operates with an upward flow, the operating conditions are as follows, both for case a) and for case b):

Temperature at the riser outlet comprised between 520° C. and 600° C.,

C/O ratio comprised between 6 and 14, and preferentially comprised between 7 and 12, Residence time comprised between 1 and 10 s, and preferentially comprised between 2 and 6 s.

When the catalytic cracking unit operates with a downward flow, the operating conditions are as follows, both for case a) and for case b):

Temperature at the reactor outlet comprised between 580° C. and 630° C.,

C/O ratio comprised between 15 and 40, and preferentially comprised between 20 and 30, Residence time comprised between 0.1 and 1 s, and preferentially comprised between 0.2 and 0.7 s.

The C/O ratio is the ratio of the mass flow rate of catalyst circulating in the unit to the mass flow rate of feedstock at the inlet to the unit.

The residence time is defined as the volume of the riser (m3) over the volume flow rate of feedstock ($m^3/s$).

DETAILED DESCRIPTION OF THE INVENTION

The present invention applies equally well to FCC units using a reactor operating with an upward flow (called a "riser"), and to units using a reactor operating with a downward flow (called a "downer").

The present invention also applies to FCC units operating with a single reactor (with an upward flow or with a downward flow), and to FCC units operating with two reactors.

The present invention consists of a catalytic cracking process system allowing better upcycling of the heat recovered from the combustion fumes in order to maximize the production of high-pressure steam and/or to limit the utilities of the unit such as (and non-exhaustively) fuel oil, fuel gas, aromatic coking cut.

The present invention can be defined as a preheating of the combustion air downstream of the MAB by heat exchange with the combustion fumes originating from the regeneration unit and/or other sources of calories with a heat level compatible with an exchange with this combustion air.

The calories of the combustion fumes leaving the regeneration section or other sources such as for example the fumes from the furnace of the atmospheric distillation column, or of the vacuum distillation column, are transmitted to the combustion air by conventional heat exchange at the outlet of the air compressor.

These calories are then transmitted to the catalyst in the regenerator since the combustion air and the catalyst are brought into direct contact at a high heat level (temperature comprised between 600° C. and 800° C.).

The excess heat introduced by the preheating of the combustion air can then be converted to high-pressure steam, for example via a "cat cooler" in order to continue to ensure the heat balance of the unit. Finally, the preheating of the combustion air described in the present invention makes it possible to produce more high-pressure steam compared with a conventional combustion fumes integration system. This will become more clearly apparent on reading the following comparative examples (Examples 1 and 2 and Examples 3 and 4).

As the sought steam is high-pressure steam at a high heat level as explained previously, the fumes leaving the generator will serve at most to produce high-pressure steam by exchange with water or medium-pressure steam.

Once the heat level of the fumes no longer makes it possible to generate high-pressure steam, the exchange switches to the combustion air. Finally, after the exchange with the combustion air, the calories remaining in the fumes at a lower heat level serve, in the last stage, to generate low-pressure steam.

Non-compliance with the precise location of this exchange cascade between the fumes from the regenerator and the combustion air does not allow maximum optimization of the overall production of high-pressure steam and hence maximum optimization of the eco-efficiency of the process.

Preheating of the air upstream of the compressor has no benefit to the extent that the intake volume flow rate of this equipment will significantly increase, which has the consequence not only of increasing the cost of the compressor, but above all of increasing the consumption of the utility associated with its operation (electricity, high-pressure steam etc.), limiting or even completely eliminating the expected energy gain. The addition of the air preheater downstream of the compressor will also have an impact on the hydraulics of the circuit but remains low enough for energy gains to be observed.

The additional supply of heat via the combustion fumes can also make it possible to reduce to a certain extent the preheating of the feedstock, usually carried out via a furnace operating on fuel oil or natural gas, which thus makes it possible to reduce the process utilities thus improving its eco-efficiency.

The system according to the present invention can also be implemented in the case of a catalytic cracking unit, the heat balance of which can be ensured only by the exchange of heat between the regeneration zone and the reaction zone. In this case, the exchange carried out between the combustion fumes and the combustion air at the regenerator makes it possible to economize on the heat source used in order to achieve the heat balance and thus to improve the overall eco-efficiency of the unit.

The heat source on which economies are made can be, non-exhaustively:

fuel gas or fuel oil in the case where the balancing is ensured by enhanced preheating of the feedstock, an additional cut rich in aromatic compounds, injected into the stripper or into a side chamber of the stripper, as described for example in US patent 2013/8,551,324 torch oil or a cut with a high coking potential usually introduced into the regenerator, thus avoiding the phenomena of afterburning and degradation of the catalyst as described previously.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 14/50.194, filed Jan. 10, 2014, are incorporated by reference herein.

COMPARATIVE EXAMPLES

In order to illustrate the effect sought by the present invention, we considered a first example referred to as a "basic case of a unit operating with excess coke" corresponding to a catalytic cracking unit (FCC) processing a feedstock producing more coke than required by the heat balance. The associated excess heat is removed via a cat cooler in order to produce high-pressure steam.

In this basic case, the heat integration of the fumes corresponds to a conventional system.

Example 2 dealt with corresponds to the same unit but this time with heat integration of the combustion fumes corresponding to implementation according to the present invention.

Example 3, referred to as a "basic case of a unit operating with insufficient coke" illustrates the reference case of an FCC, the operating conditions of which do not make it possible to ensure the heat balance.

The heat balance is in this case achieved by the additional preheating of the feedstock via a furnace operating with fuel oil. In this Example 3, the heat integration of the fumes is carried out according to a conventional system; the unit clearly does not have a cat cooler.

Example 4 repeats Example 3 but with the implementation according to the invention.

In all the examples the pressure and temperature conditions of the different steams generated are as follows:

| | Pressure bar g | Temperature ° C. |
|---|---|---|
| High-pressure steam | 44.9 | 385 |
| Medium-pressure steam | 21.8 | 290 |
| Low-pressure steam | 4.0 | 230 |

Example 1 (According to the Prior Art)

Basic Case of a Unit Operating with Excess Coke

In the example considered, the fumes arrive at a temperature of 675° C. upstream of the waste heat boiler with a mass flow rate of 295 tonnes per hour and are successively directed towards:

1—a steam generation unit referred to as a waste heat boiler, making it possible to generate high- and medium-pressure steam. At the end of this stage, the fumes leave at 340° C.

2—an electro-precipitator for removing dust therefrom.

3—an economizer 1 which makes it possible to generate low-pressure steam and to preheat water. At the end of this stage, the temperature of the fumes drops from 340° C. to 200° C. in order to retain a minimum heat level with respect to the constraints of the downstream DeNOx and DeSOx stages.

4—DeSOx and DeNOx units, which do not affect the heat level of the fumes.

5—an economizer 2 for preheating the water serving to produce high-pressure steam in the waste heat boiler.

At the end of these different stages, the fumes leave at 180° C. with the following properties:

SO2<10-20 mg/Nm3

NO2<15 mg/Nm3

NOx<200 mg/Nm3

Fines content<10 mg/Nm3

With this conventional arrangement the high-, medium- and low-pressure steams are generated in the following proportions:

| t/h | Waste heat boiler | Economizer 1-2 | "Cat cooler" |
|---|---|---|---|
| High-pressure steam | 86.8 | 0 | Base |
| Medium-pressure steam | 6.2 | 0 | 0 |
| Low-pressure steam | 0 | 17.8 | 0 |

The high-pressure steam generated by the cat cooler corresponds to the quantity of heat to be removed from the regenerator in order to achieve the heat balance of the unit.

Example 2 (According to the Invention)

Implementation of the Invention in the Case of a Unit Operating with Excess Coke This example corresponds to the arrangement of the invention as described in this text with positioning of the combustion air preheater downstream of the electro-precipitator.

In the last case, the fumes leave all of the post-treatment stages also at 180° C. with the same NOx, SOx concentrations and fines content as previously.

As a result, the system according to the invention does not at all affect the post-treatment performances making it possible to bring the fumes up to the legal standards for discharge into the atmosphere.

In the system according to the invention, the production of steam is distributed as follows:

| t/h | Waste heat boiler | Economizer 1-2 | "Cat cooler" |
|---|---|---|---|
| High-pressure steam | 86.8 | 0 | Base + 6.8 |
| Medium-pressure steam | 6.2 | 0 | 0 |
| Low-pressure steam | 0 | 10.5 | 0 |

According to the present invention, 6.8 additional tonnes of high-pressure steam are produced by transfer of 5 MW from the fumes to the regenerator, taking into account the loss of feedstock linked to the presence of this novel air-fumes exchanger. These 5 MW are then converted to high-pressure steam via the cat cooler in order to maintain the heat balance of the unit.

In other words, the "cat cooler" does not extract only the calories making it possible to ensure the heat balance of the FCC, but an additional quantity of high-pressure steam (6.8 t/h).

The system according to the invention thus makes it possible indirectly to transform low-pressure steam which is not very usable, to high-pressure steam having a high added value to the extent that this high-pressure steam is at a heat level which makes it possible for it to be a heat source for a process flow range that is much more extensive than the low-pressure steam.

Overall, the system according to the present invention makes it possible to improve the eco-efficiency of the process. As the operating conditions of the reactor are not modified, the yields and selectivities of the products remain the same.

Example 3 (According to the Prior Art)

Basic Case of a Unit Operating with Insufficient Coke

In this example, the unit operates under operating conditions which do not make it possible to ensure the heat balance of the system. In this case, this heat balance is ensured by increasing the feedstock preheating temperature via a furnace, at the cost of fuel oil consumption.

In this configuration no cat cooler is required to the extent that the preheating of the feedstock is ensured by consuming a minimum amount of fuel oil in the preheating furnace in order to achieve the heat balance.

Under these conditions the fumes enter the waste heat boiler this time at 650° C. at a flow rate of 230 tonnes per hour.

Temperature and flow rate are lower than in Example 1 since a smaller quantity of coke is burnt in the regenerator.

In this Example 3, the fumes follow the same post-treatment stages as in Example 1.

Thus high-, medium- and low-pressure steam is generated in the following proportions:

| t/h | Waste heat boiler | Economizer 1&2 |
|---|---|---|
| High-pressure steam | 71.1 | |
| Medium-pressure steam | 6.2 | |
| Low-pressure steam | 0 | 15.3 |

Example 4 (According to the Invention)

Implementation of the Innovation in the Case of a Unit Operating with Insufficient Coke In this example, the integration of the fumes according to the invention is implemented.

Once again the fumes leave the post-treatment stage under the same temperature and composition conditions as for Example 3.

Due to the preheating of the combustion air, 4.5 MW are transferred to the regenerator, which makes it possible to reduce the fuel oil consumption by 395 kg/h, taking into account the additional loss of feedstock linked to the presence of the novel air-fumes exchanger.

The production of steam is distributed thus:

| t/h | Waste heat boiler | Economizer 1&2 |
|---|---|---|
| High-pressure steam | 71.1 | |
| Medium-pressure steam | 6.2 | |
| Low-pressure steam | 0 | 8.8 |

In this case, the system according to the invention has indirectly made it possible to replace 395 kg/h of the fuel oil by 6.5 t/h of low-pressure steam which could not have been used directly in order to preheat the feedstock in view of its low heat level.

The system according to the invention therefore allows better upcycling of the heat from the fumes thus making it possible to improve the eco-efficiency of the process.

In the same way as for Example 2, the operating conditions of the reactor ("riser" or "downer") being kept identical, the innovation in no event affects the yields and the selectivity of the products formed.

These examples illustrate the way in which the system according to the invention makes it possible to transfer calories from a low heat level to a high heat level thus making it possible to improve the eco-efficiency of the process.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. Process comprising:

catalytic cracking of heavy hydrocarbon cuts wherein said heavy hydrocarbon cuts are VGO or atmospheric residue, using a fluidized bed catalytic cracking unit comprising:

a reaction section with an upward flow or with a downward flow, and a catalyst regeneration section wherein said catalyst regeneration section consists of combustion of a coke deposited on a catalyst in the reaction section by combustion air, wherein said catalyst regeneration section produces flue gas that exchange calories inside a waste heat boiler, the flue gas from the waste heat boiler is introduced in an electric precipitator (ESP), then in an economizer (ECO) that allows for the production of low pressure superheated steam (LPSH) from low pressure water (LPBFW), and for the production of high pressure superheated water (HPBFW) from high pressure water, a cat cooler wherein said cat cooler is a fluidized bed exchanger suitable for generating high-pressure steam (HPS) from calories directly contained on a hot catalyst in a process of regeneration, wherein said combustion air in said process is preheated to a temperature of between 200 and 350° C. by a heat exchange using regeneration fumes collected downstream of a waste heat boiler and upstream of an economizer, wherein said regeneration fumes at this location are at a temperature of between 300° C. and 650° C., and wherein the excess calories supplied by the combustion air are converted to high-pressure steam of between 45 and 100 bar at a level of an external exchanger on hot catalyst collected at said cat cooler.

2. The process for the catalytic cracking of hydrocarbon cuts of claim 1, wherein the reaction section operates with an upward flow with the following operating conditions:

a temperature at a riser outlet of between 520° C. and 600° C., a C/O ratio of between 6 and 14, a residence time of between 1 and 10 s.

3. The process for the catalytic cracking of hydrocarbon cuts of claim 1, wherein the reaction section operates with a downward flow with the following operating conditions:

a temperature at a riser outlet of between 580° C. and 630° C., a C/O ratio of between 15 and 40, and a residence time of between 0.1 and 1 s.

4. The process for the catalytic cracking of hydrocarbon cuts of claim 1, wherein the combustion air in said process is preheated to a temperature of between 250° C. and 300° C.

5. The process for the catalytic cracking of hydrocarbon cuts of claim 1, wherein the high-pressure steam is between 50 and 70 bar.

6. The process for the catalytic cracking of hydrocarbon cuts of claim 2, wherein the C/O ratio is between 7 and 12.

7. The process for the catalytic cracking of hydrocarbon cuts of claim 2, wherein the residence time is between 2 and 6 s.

8. The process for the catalytic cracking of hydrocarbon cuts of claim 3, wherein the C/O ratio is between 20 and 30.

9. The process for the catalytic cracking of hydrocarbon cuts of claim 1, wherein the residence time is between 0.2 and 7 s.

10. The process for the catalytic cracking of hydrocarbon cuts of claim 1, wherein the high-pressure steam is used as a heat source in an external process.

11. The process of claim 1, wherein the cat cooler is a heat exchanger disposed on the side of the regenerator and is suitable for allowing the catalyst to be returned continuously through an outlet disposed on the lower side of the cat cooler.

12. The process of claim 11, wherein the catalyst particles move in an out the exchanger by gravity and pressure differences.

13. A process comprising:

catalytic cracking of hydrocarbon cuts of wherein said heavy hydrocarbon cuts are VGO or atmospheric residue, using a fluidized bed catalytic cracking unit comprising a reaction section with an upward flow or with a downward flow, and a catalyst regeneration section which consists of combustion of coke deposited on a catalyst in the reaction section by combustion air, said process comprising no cat cooler, and wherein the combustion air is preheated to a temperature of between 200° C. and 350° C. by a heat exchange using regeneration fumes collected downstream of a waste heat boiler and upstream of an economizer, said regeneration fumes available at this location at a temperature between 300° C. and 650° C., and wherein excess calories are supplied by the combustion air suitable to reduce the consumption of fuel by the furnace for preheating said combustion air.

14. The process for the catalytic cracking of hydrocarbon cuts of claim 13, wherein the reaction section operates with an upward flow with the following operating conditions:

a temperature at a riser outlet of between 520° C. and 600° C., a C/O ratio of between 6 and 14, and a residence time of between 1 and 10 s.

15. The process for the catalytic cracking of hydrocarbon cuts of claim 13, wherein the reaction section operates with a downward flow under the following operating conditions:

a temperature at a reactor outlet of between 580° C. and 630° C., a C/O ratio of between 15 and 40, a residence time of between 0.1 and 1 s.

16. The process for the catalytic cracking of hydrocarbon cuts of VGO type or atmospheric residue, using a fluidized bed catalytic cracking unit of claim 13, wherein the combustion air is preheated to a temperature of between 250° C. and 300° C.

17. The process for the catalytic cracking of hydrocarbon cuts of VGO type or atmospheric residue, using a fluidized bed catalytic cracking unit of claim 14, wherein the C/O ratio is between 7 and 12.

18. The process for the catalytic cracking of hydrocarbon cuts of VGO type or atmospheric residue, using a fluidized bed catalytic cracking unit of claim 14, wherein the residence time is between 2 and 6 s.

19. The process for the catalytic cracking of hydrocarbon cuts of VGO type or atmospheric residue, using a fluidized bed catalytic cracking unit of claim 15, wherein the C/O ratio is between 20 and 30.

20. The process for the catalytic cracking of hydrocarbon cuts of VGO type or atmospheric residue, using a fluidized bed catalytic cracking unit of claim 15, wherein the residence time is between 0.2 and 0.7 s.

* * * * *